US005885373A

United States Patent [19]

Sienkowski

[11] Patent Number: 5,885,373

[45] Date of Patent: Mar. 23, 1999

[54] CHROMIUM FREE, LOW ORGANIC CONTENT POST-RINSE FOR CONVERSION COATINGS

[75] Inventor: Michael L. Sienkowski, Warren, Mich.

[73] Assignee: Henkel Corporation, Gulph Mills, Pa.

[21] Appl. No.: 873,208

[22] Filed: Jun. 11, 1997

[51] Int. Cl.[6] ..... C23C 22/48

[52] U.S. Cl. ..... 148/247; 148/251; 148/255; 148/256; 148/259; 148/261; 148/262; 148/273; 148/274; 148/275; 148/283

[58] Field of Search ..... 148/247, 251, 148/255, 256, 259, 261, 262, 273, 274, 275, 283

[56] References Cited

U.S. PATENT DOCUMENTS

| | | | |
|---|---|---|---|
| 4,433,015 | 2/1984 | Lindert | 427/388.4 |
| 4,517,028 | 5/1985 | Lindert | 148/6.14 R |
| 4,963,596 | 10/1990 | Lindert et al. | 526/313 |
| 5,039,770 | 8/1991 | Lindert et al. | 526/312 |
| 5,063,089 | 11/1991 | Lindert et al. | 427/354 |
| 5,342,456 | 8/1994 | Dolan | 148/255 |
| 5,427,632 | 6/1995 | Dolan | 148/247 |
| 5,449,415 | 9/1995 | Dolan | 148/247 |

*Primary Examiner*—David A. Simmons
*Assistant Examiner*—Robert R. Koehler
*Attorney, Agent, or Firm*—Ernest G. Szoke; Wayne C. Jaeschke; Norvell E. Wisdom, Jr.

[57] ABSTRACT

A solution in water of fluorometallate and phosphate anions, divalent and/or trivalent metal cations, and polyhydroxylaminomethyl substituted polymers of vinyl phenol(s) provides an effective and economical post-rinse for conversion coatings, particularly predominantly zinc phosphate coatings that also contain manganese and may contain other cations.

20 Claims, No Drawings

CHROMIUM FREE, LOW ORGANIC CONTENT POST-RINSE FOR CONVERSION COATINGS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to post-rinse compositions and processes for improving the corrosion protective qualities of conversion coatings on metal substrates. Such materials and processes may alternatively be called, among other names, "final rinses", "passivating rinses [or treatments]", "post-treatments", or "sealing rinses [or treatments]". Their fundamental characteristics are that (1) they are contacted with the substrate to be treated only after completion of formation of a conversion coating and therefore normally have no direct contact with the underlying metal substrate, except possibly through pores in the conversion coating and (2) contact with the post-rinses, optionally followed by application of one or more additional protective coatings, results in a surface with better corrosion resistance, in at least one type of service or accelerated test procedure, than that shown in the same service or test by otherwise identical substrates treated in the same way, except for substituting contact with pure water for contact with the post-rinse.

Before the development of modern environmental consciousness in the last few decades, aqueous solutions containing hexavalent chromium were almost always used as post-rinses after the most common kinds of conversion coatings, those in which the predominant anions are phosphate and/or chromate ions. Hexavalent chromium is now regarded as a serious pollutant, however, so that eliminating or at least minimizing its use has been an objective of the metal finishing industry for about twenty years. Even so, no fully satisfactory replacement for aqueous hexavalent chromium containing solutions for all post-rinse uses has yet been provided.

In addition to causing pollution problems, hexavalent chromium containing aqueous solution post-rinses must normally, in order to obtain the maximum degree of corrosion resistance increase available from using them, be dried into place on a substrate treated with them before any subsequent operation in which the substrate previously treated with a hexavalent chromium containing post-rinse is contacted with another aqueous liquid composition. Even after such drying into place of a hexavalent chromium containing aqueous solution post-rinse, chromium can be leached from a substrate treated with it by contact with certain kinds of liquids subsequently used to treat the same substrate. This can cause paint discoloration and similar undesirable blemishes on the treated surface and can substantially reduce the corrosion protective value of the hexavalent chromium containing post-rinse aqueous solution treatment.

It is believed that the most generally satisfactory replacements for post-rinses containing hexavalent chromium that are now widely known and used in the art are aqueous solutions/dispersions containing predominantly, among their active ingredients, base polymers of vinyl phenol, on at least some of the aromatic rings of which have been grafted alkyl and/or hydroxy alkyl amino methylene groups, substituting for hydrogen atoms that would be present on the aromatic rings in a simple polymer of vinyl phenol. Syntheses and uses of these polymers are described in the following U. S. Patents to Lindert et al., all of which, except to any extent that may be inconsistent with any explicit statement herein, are hereby incorporated herein by reference: U.S. Pat. No. 4,433,015 of Feb. 21, 1981; U.S. Pat. No. 4,517,028 of May 14, 1985; U.S. Pat. No. 4,963,596 of Oct. 16, 1990; U.S. Pat. No. 5,039,770 of Aug. 13, 1991; and U.S. Pat. No. 5,063,089 of Nov. 5,1991. These materials, which may be collectively denoted hereinafter as "amino modified polyvinylphenol", have been found technically satisfactory in most types of post-rinse applications but have a substantially higher cost than conventional hexavalent chromium containing post-rinses. This higher cost has hampered acceptance of the amino modified polyvinylphenol type post-rinses.

Accordingly, one object of this invention is to provide a more economical, but still chromium free, post-rinse composition and process compared with previously used amino modified polyvinylphenol post-rinses. Another alternative or concurrent object is to provide a post-rinse composition and process after use of which the treated surface may be freely rinsed with aqueous liquid compositions without substantially reducing the corrosion protective quality that otherwise could be achieved. Other concurrent or alternative objects will be apparent from the description below.

Except in the claims and the operating examples, or where otherwise expressly indicated, all numerical quantities used in the description of the invention to indicate amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not necessarily preclude unspecified chemical interactions among the constituents of a mixture once mixed; specification of materials in ionic form implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may by used for any chemical species defined by all of the types and numbers of atoms present in it, irrespective of whether the species is ionic, neutral, unstable, hypothetical, or in fact a stable neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18°–25° C.

BRIEF SUMMARY OF THE INVENTION

It has been found that a satisfactory post-rinse composition meeting at least one of the objects of the invention is an aqueous liquid composition that comprises, preferably consists essentially of, or more preferably consists of, water and:

(A) a component of fluorometallate anions, each of said anions consisting of (i) at least four fluorine atoms, (ii) at least one atom of an element selected from the group consisting of titanium, zirconium, hafnium, silicon, aluminum, and boron, and, optionally, one or both of (iii) at least one ionizable hydrogen atom, and (iv) at least one oxygen atom; preferably the anions are fluorotitanate (i.e., $TiF_6^{-2}$) or fluorozirconate (i.e., $ZrF_6^{-2}$), most preferably fluorotitanate;

(B) a component of divalent or tetravalent cations of elements selected from the group consisting of cobalt, magnesium, manganese, zinc, nickel, tin, copper, zirconium, iron, and strontium; preferably, with increasing preference in the order given, at least 60, 70, 80, 90, 95, or 99% by weight of the total of component (B) consists of cobalt, nickel, manganese, or magnesium, more preferably of manganese, cobalt, or nickel, most preferably of manganese; independently, the ratio of the total number of cations of this component to the total number of anions of component (A) preferably is at least, with increasing preference in the order given, 0.20:1.0, 0.33:1.0, 0.40:1.0, 0.60:1.0, 0.70:1.0, 0.80:1.0, 0.90:1.0, 1.00:1.0, or 1.10:1.0 and independently preferably is not more than, with increasing preference in the order given, 3:1.0, 2.5:1.0, 2.1:1.0, 1.8:1.0, 1.6:1.0, 1.4:1.0, or 1.20:1.0;

(C) a component of phosphorus-containing inorganic oxyanions and/or phosphonate anions; and (D) a component of water-soluble and/or -dispersible organic polymers and/or polymer-forming resins, preferably in an amount such that the ratio of the solids content of the organic polymers and polymer-forming resins in the composition to the content of component (A) in the same composition is at least, with increasing preference in the order given, 0.2:1.0, 0.5:1.0, 0.75:1.0, 0.90:1.0, 1.05:1.0, 1.10:1.0, 1.15:1.0, or 1.20:1.0 and independently preferably is not more than, with increasing preference in the order given, 3.0:1.0, 2.6:1.0, 2.3:1.0, 2.0:1.0, 1.7:1.0, 1.5:1.0, or 1.3:1.0; and, optionally, one or more of the following components:

(E) a pH-adjusting component that is not part of any of the previously recited components;

(F) a component of dissolved oxidizing agent that is not part of any of the previously recited components, preferably a peroxy compound, more preferably hydrogen peroxide; and (G) a component selected from dissolved or dispersed complexes, stabilized against settling, that are not part of any of the previously recited components, said complexes resulting from reaction between (1) a material selected from fluorometallate anions, each of said anions consisting of (1.1) at least four fluorine atoms, (1.2) at least one atom of an element selected from the group consisting of titanium, zirconium, hafnium, silicon, aluminum, and boron, and, optionally, one or both of (1.3) ionizable hydrogen atoms and (1.4) one or more oxygen atoms and (2) one or more materials selected from the group consisting of metallic and metalloid elements and the oxides, hydroxides, and carbonates of these metallic or metalloid elements, said reaction producing a reaction product that is not part of any of the previously recited components; preferably this component results from reaction of silica or of vanadium(V) oxide as reactant (2).

Such a composition may be ready for use in treating a conversion coated substrate, in which instance it may be called a "working" composition; or it may be suitable for dilution with water only to provide a working composition, in which instance it may be called a "concentrate", "concentrate composition", or "concentrated composition", all three of which terms are to be considered as interchangeable herein. Many compositions are suitable for either use according to the invention.

The term "stabilized against settling" in the description of component (G) above means that the composition containing the material does not suffer any visually detectable settling or separation into distinct liquid phases when stored for a period of 100, or more preferably 1000, hours at 25° C.

It should be understood that the components listed above for a composition used in a process according to the invention need not necessarily all be provided by separate chemicals. For example, it is preferred that the fluorometallate anions and phosphorous containing anions both be added in the form of the corresponding acids, thereby also providing at least some of pH adjusting component (E).

The principal embodiments of the invention are a process in which a pre-existing conversion coating is brought into contact with a composition as described above for use according to the invention, optionally as part of a sequence of process steps the others of which may be conventional per se, and an article of manufacture including a surface treated by a process according to the invention.

BRIEF DESCRIPTION OF THE SEVERAL VIEWS OF THE DRAWING

Not Applicable.

DETAILED DESCRIPTION OF THE INVENTION

For a variety of reasons, it is preferred that compositions used according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0.001, or 0.0002, percent of each of the following constituents: hexavalent chromium; ferricyanide; ferrocyanide; sulfates and sulfuric acid; anions containing molybdenum or tungsten; alkali metal and ammonium cations; pyrazole compounds; sugars; gluconic acid and its salts; glycerine; α-glucoheptanoic acid and its salts; and myoinositol phosphate esters and salts thereof.

As a general guide, it is normally preferable, independently for each preference given and with increasing preference in the order given for each preference, if a working composition according to this invention has: a concentration of at least 0.0010, 0.0020, 0.0030, 0.0040, 0.0045, 0.0050, 0.0055, 0.0060 or 0.0065, but not more than 0.06, 0.04, 0.025, 0.020, 0.014, 0.012, 0.010, 0.0090, 0.0085, 0.0080, 0.0075, or 0.0070, moles per kilogram of total composition (hereinafter usually abbreviated as "M/kg") of fluorometallate anions from component (A); at least 0.0015, 0.0025, 0.0030, 0.0035, 0.0040, 0.0045, 0.0050, 0.0055, 0.0060, 0.0065, 0.0070, 0.0073 or 0.0076, but not more than 0.07, 0.05, 0.03, 0.025, 0.020, 0.015, 0.012, 0.010, or 0.0080, M/kg of phosphorus from component (C); a ratio of the concentration of phosphorus from component (C) in M/kg to the concentration of fluorometallate anions from component (A) in M/kg that is at least 0.12:1.0, 0.25:1.0, 0.35:1.0, 0.45:1.0, 0.55:1.0, 0.65:1.0, 0.75:1.0, 0.85:1.0, 0.95:1.0, 1.00:1.0, 1.05:1.0, or 1.10:1.0 and independently preferably is not more than 5.0:1.0, 4.0:1.0, 3.5:1.0, 3.0:1.0, 2.5:1.0, 2.0:1.0, 1.8:1.0, 1.6:1.0, 1.50:1.0, 1.40:1.0, 1.30:1.0, 1.25:1.0, 1.20:1.0, or 1.15:1.0; and at least 0.010, 0.020, 0.030, 0.040, 0.060, 0.080, 0.100, 0.120, or 0.130, but not more than 1.2, 1.0, 0.8, 0.6, 0.50, 0.40, 0.35, 0.30, 0.25, 0.20, 0.18, 0.16, or 0.14, % of solids from component (D). If the concentration is too large, the danger of dissolving away part of the conversion coating, and thereby reducing rather than increasing the corrosion resistance of the coated substrate, is substantial. On the other hand, if the concentration is too low, any increase in corrosion resistance obtained may be insignificant.

Component (C) as defined above is to be understood as including all of the following inorganic acids and their salts that may be present in the composition: hypophosphorous acid ($H_3PO_2$), orthophosphorous acid ($H_3PO_3$), pyrophosphoric acid ($H_4P_2O_7$), orthophosphoric acid ($H_3PO_4$), tripolyphosphoric acid ($H_5P_3O_{10}$), and further condensed phosphoric acids having the formula $H_{x+2}P_xO_{3x+1}$, where x is a positive integer greater than 3. Component (C) also includes all phosphonic acids and their salts.

Generally, inorganic phosphates, particularly orthophosphates, phosphites, hypophosphites, and/or pyrophosphates, especially orthophosphates, are preferred for component (C) because they are more economical. Phosphonates are also suitable and may be advantageous for use with very hard water, because the phosphonates are more effective chelating agents for calcium ions. Acids and their salts in which phosphorus has a valence less than five may be less stable than the others to oxidizing agents and are less preferred in compositions according to the invention that are to contain oxidizing agents.

Component (D) is preferably selected from the group consisting of epoxy resins, aminoplast (i.e., melamine-formaldehyde and urea-formaldehyde) resins, tannins, phenolformaldehyde resins, and polymers of vinyl phenol with sufficient amounts of alkyl- and substituted alkylaminomethyl substituents on the phenolic rings to render the polymer water soluble or dispersible. More preferably, component (D) is selected from epoxy resins and/or, most preferably only from, polymers and/or copolymers of one or more y-(N-$R^1$-N-$R^2$-aminomethyl)-4-hydroxy-styrenes, where y=2, 3, 5, or 6, $R^1$ represents an alkyl group containing from 1 to 4 carbon atoms, preferably a methyl group, and $R^2$ represents a substituent group conforming to the general formula $H(CHOH)_nCH_2$-, where n is an integer from 1 to 7, preferably from 3 to 5. The average molecular weight of these polymers preferably is within the range from 700 to 70,000, or more preferably from 3,000 to 20,000.

The pH of a composition used according to the invention preferably is at least, with increasing preference in the order given, 1.0, 1.5, 2.0, 2.3, 2.5, 2.7, 2.90, 3.00, 3.10, 3.20, 3.30, or 3.40 and independently preferably is not more than, with increasing preference in the order given, 6.0, 5.5, 5.0, 4.7, 4.5, 4.3, 4.1, 3.9, 3.70, or 3.60. If the pH is too low, most or all of the underlying conversion coating can be removed by dissolution during contact with the post-rinse composition, while if the pH is too high, less corrosion protection normally will be achieved by a treatment according to the invention. If components (A) and (C) are provided from the corresponding acids as is generally preferred, an alkalinizing pH adjusting agent will normally be required to obtain a pH within the more preferred ranges. Aqueous ammonia is preferably used to raise the pH in such circumstances. If the pH value is higher than desired, substitution of phosphoric and/or fluorometallic acid for at least part of any other materials used to supply components (A) and/or (C) is preferably used to lower the pH.

If used, although it normally preferably is not, component (F) preferably is present in a working composition to be used in a process according to this invention in an amount to provide a concentration of oxidizing equivalents per liter of composition that is equal to that of a composition containing from 0.05 to 1.5, or more preferably from 0.10 to 0.90% of hydrogen peroxide. (The term "oxidizing equivalent" as used herein is to be understood as equal to the number of grams of oxidizing agent divided by the equivalent weight in grams of the oxidizing agent. The equivalent weight of the oxidizing agent is the gram molecular weight of the agent divided by the change in valency of all atoms in the molecule which change valence when the molecule acts as an oxidizing agent; usually, this is only one element, such as oxygen in hydrogen peroxide.)

Component (G) is not generally needed and therefore at least for simplicity is preferably not included. If its presence is desired, however, materials for component (G) may be prepared by adding one or more metallic and/or metalloid elements or their oxides, hydroxides, and/or carbonates to an aqueous composition containing substances that, if left unreacted, could be part of component (A). A spontaneous chemical reaction normally ensues, converting the added element, oxide, hydroxide, or carbonate into a soluble species. The reaction to form this soluble species can be accelerated by use of heat and stirring or other agitation of the composition. The formation of the soluble species is also aided by the presence in the composition of suitable complexing ligands, such as peroxide and fluoride. Preferably the amount of component (G), when used, in a working composition to be used in a process according to this invention is not greater than that formed by addition, with increasing preference in the order given, of up to 1.0, 0.4, 0.24, 0.16, 0.10, or 0.080 parts per thousand, based on the ultimate total mass of the working composition, of the metallic or metalloid element or its stoichiometric equivalent in an oxide, hydroxide, or carbonate, to the concentrate composition. Independently, the amount of component (G) when used in a working composition preferably is at least as great as that formed by addition, with increasing preference in the order given, of at least 0.002, 0.0040, 0.010, or 0.020 parts per thousand, based on the ultimate total mass of the working composition, of the metallic or metalloid element or its stoichiometric equivalent in an oxide, hydroxide, or carbonate, in the working composition.

A working composition to be used in a process according to the invention may be applied to a conversion coated metal substrate by any convenient method, several of which will be readily apparent to those skilled in the art. For example, coating the metal with a liquid film may be accomplished by immersing the substrate in a container of the liquid composition, spraying the composition on the substrate, coating the surface by passing it between upper and lower rollers with the lower roller immersed in a container of the liquid composition, contact with a brush or felt saturated with the liquid treatment composition, and the like, or by a mixture of methods. Excessive amounts of the liquid composition that might otherwise remain on the surface prior to drying may be removed before drying by any convenient method, such as drainage under the influence of gravity, using squeegees, passing between rolls, and the like, or most preferably and most commonly, by rinsing with water. The temperature during application of the liquid composition may be any temperature within the liquid range of the composition, although for convenience and economy in application, normal room temperature, i.e., from 18°–24° C., is usually preferred. The time of contact between the substrate being post-rinsed and a post-rinse composition to be used in a process according to the invention preferably is at least, with increasing preference in the order given, 5, 10, 14, 18, 21, 23, 25, 27, or 29 seconds and independently preferably, primarily for reasons of economy, is not more than 500, 250, 150, 100, 90, 80, 70, 60, 50, 45, 40, 37, 34, or 31 seconds.

As would be expected from the term "post-rinse", a composition to be used in a process according to this invention is preferably applied to the conversion coating to be treated without allowing the conversion coating to dry between the time of its formation and contact with a composition to be used in a process according to this invention. The conversion coating, however, may be, and normally preferably is, rinsed with plain water before being contacted with a composition to be used in a process according to the invention.

A process according to the invention can be used after any type of conversion coating, but is particularly valuable for, and therefore preferably applied to, treating zinc phosphate conversion coatings that also contain manganese, these conversion coatings independently preferably being formed on substrates of metals that consist predominantly of elements selected from the group consisting of iron, zinc, and aluminum. Still more preferably, at least one of the following combinations of metal substrate and conversion coating is treated:

cold rolled steel, electrogalvanized steel, and/or electrocoated zinc-iron alloy with a phosphate conversion coating that contains zinc, manganese, and nickel cations and optionally also may contain iron, cobalt, magnesium, calcium, copper, silver, barium, and/or bismuth cations; and cold rolled steel, electrocoated zinc-iron alloy, and/or aluminum alloy containing at least 90% of aluminum with a phosphate conversion coating that contains zinc and manganese cations and optionally also may contain iron, cobalt, magnesium, calcium, copper, silver, barium, and/or bismuth cations but contains not more than, with increasing preference in the order given, 5, 3, 2, 1, 0.5, 0.2, or 0.1% of nickel cations.

Among these combinations, that of a cold rolled steel substrate with a low nickel zinc manganese phosphate conversion coating is particularly preferred.

The invention and its benefits may be further appreciated by consideration of the following working examples and comparison examples.

Four types of substrates were treated and/or tested. All were obtained in the form of conventional rectangular test panels from Advanced Coating Technologies, Inc, (hereinafter usually abbreviated as "ACT"), Hillsdale, Michigan and were reported by their supplier to represent four widely used types of metallic substrates conventionally phosphate conversion coated. These materials were designated by the supplier as follows, except that the parenthetical abbreviation after each designation was assigned to represent these substrates below in this specification: ACT Cold Rolled Steel ("CRS"); ACT Electrogalvanized Steel ("EG"), galvanized on both sides; ACT Steel Electroplated with Zinc-iron Alloy ("EGA"), plated on both sides with 45 grams per square meter of an alloy containing 10–15% iron, with the balance zinc; and ACT Type 6111 Aluminum ("A6111").

A concentrate for use in preparing working compositions to be used according to the invention was prepared to contain the ingredients shown in Table 1 below. The solution of polymer of substituted vinyl phenol used was made according to the directions of column 11 lines 39–52 of U.S. Pat. No. 4,963,596, except that in the final dilution an amount of orthophosphoric acid equal to a final concentration of 0.3% $H_3PO_4$ was used in addition to the deionized water described in the patent. The solution contained 10% of the solid polymer. This solution is identified below as "Aminomethyl substituted polyvinyl phenol solution". The concentrate was prepared generally by adding the acidic ingredients to most of the "other deionized water" shown, then dissolving the manganese(II) oxide, which reacts to yield manganese phosphates and water, then adding the solution of the aminomethyl substituted polyvinyl phenol, and finally adding enough deionized water to bring the total parts to 1000.

TABLE 1

| Ingredient | Concentration in Parts of Ingredient in Concentrate Composition: |
|---|---|
| 60% $H_2TiF_6$ in water | 82 |
| 75% $H_3PO_4$ in water | 45 |
| Manganese(II) oxide (i.e., MnO) | 24 |
| Aminomethyl substituted polyvinyl phenol solution | 602 |
| Other deionized water | 347 |

The following process steps were used in manufacturing the phosphated test panels described in these working examples and comparison examples:

1. Clean in a solution of 21 g/l of PARCO® Cleaner 1501 concentrate in water at 43.3° C. for 90 seconds by spraying.
2. Rinse with warm water for 30 seconds by spraying.
3. Condition the surface by spraying for 30 seconds with a solution of 1.5 g/l of FIXODINE® Z8 concentrate in water, the solution having a pH value from 8.8 to 9.2 and a temperature of 40.6° C.
4. Form a phosphate conversion coating by use of one of the following five solution and contact conditions combinations:
   4.1. Immersion for 120 seconds in a solution in water of BONDERITE® 958 concentrate, prepared according to the directions of the supplier so that the solution has 0.8 point (hereinafter usually abbreviated as "pt") of Free Acid (hereinafter usually abbreviated as "FA"); 23 pt of Total Acid (hereinafter usually abbreviated as "TA"), 0.16 g/L of $NaNO_2$, and sufficient ADDITIVE® KF to result in an Active Fluoride content corresponding to a current of 160 microamps (hereinafter usually abbreviated as "$\mu$a") on a LINEGUARD® 101 Meter, said solution being maintained during contact at a temperature of 51.7° C.

4.2. Spraying for 90 seconds with a substantially nickel free phosphating solution containing 1.4 g/l of divalent zinc cations, 1.5 g/l of divalent manganese cations, an amount of phosphorus, derived from phosphoric acid and/or zinc dihydrogen phosphate, that corresponds stoichiometrically to 12 g/l of trivalent orthophosphate anions, 3.5 g/l of nitrate anions, 1.2 pt of FA, 17 pt of TA, 0.16 g/l of $NaNO_2$, and 0.2 g/l of fluorosilicic acid (i.e., $H_2SiF_6$), said solution being maintained during its contact with the substrate at a temperature of 46.1° C.

4.3. Same as 4.2, except that the solution contained only 0.8 pt of FA and additionally contained sufficient ADDITIVE® KF to result in an Active Fluoride content corresponding to a current of 190 pa on a LINEGUARD®R 101 Meter.

4.4. Same as 4.2, except that contact was by immersion for 120 seconds instead of by spraying for 90 seconds.

4.5. Same as 4.3, except that contact was by immersion for 120 seconds instead of by spraying for 90 seconds, the LINEGUARD® 101 Meter reading was 170 instead of 190 $\mu$a, and the temperature was 51.7 instead of 46.1° C.

5. Rinse by spraying with cold water for 30 seconds.

6. Post-rinse according to the invention or a comparison thereto at normal human comfort temperature (i.e., 18° to 25° C.) for 30 seconds, using the same method of contact as in step 4 for each particular substrate sample (i.e., spraying for step 4.1, 4.2, or 4.3 and immersion for step 4.4 or 4.5) with one of the following compositions:

6.1. Deionized water.

6.2. A solution in water of 0.50% by volume of the concentrate composition described in Table 1 above, adjusted to have a pH value of 2.9 and 0.6 pt of TA by addition of aqueous ammonia.

6.3. A solution in water of 2.0% by volume of the concentrate composition described in Table 1 above, adjusted to have a pH value of 2.7 and 2.8 pt of TA by addition of aqueous ammonia.

6.4. A solution in water of 2.0% by volume of the concentrate composition described in Table 1 above, adjusted to have a pH value of 3.5 and 2.1 pt of TA by addition of aqueous ammonia.

6.5. A solution in water of 20% by volume of the concentrate composition described in Table 1 above, with 21.5 pt of TA.

6.6. A solution in water of 6 g/l of PARCOLENE® 76 post-rinse concentrate.

6.7. A solution in water of 0.75% by volume of PARCOLENE® 90 post-rinse concentrate, this solution having a pH value of 5.3.

6.8. A solution in water of 0.35% by volume of DEOXYLYTE® 54 NC concentrate, this solution having a pH of 4.7 and 5 pt of TA, measured with a 100 milliliter sample.

7. Rinse by spraying with deionized water (hereinafter usually abbreviated as "DIW") at normal human comfort temperature for 15 seconds.

8. Dry by blowing with compressed air.

9. Painting (when used) successively with cathodically electrocoated PPG Corporation ED5000 paint, DuPont white 542AB839 Base Coat, and DuPont RK8010 Clear Coat, these three paints constituting one example of a conventional high quality three part automotive body paint system.

Materials identified above as PARCO® Cleaner 1501 concentrate, FIXODINE® Z8 concentrate, BONDERITE® 958 concentrate (for preparing a phosphating solution containing zinc, manganese, and nickel phosphates, complex fluorides, and sodium nitrite accelerator), ADDITIVE™ KF, a LINEGUARD® 101 Meter, PARCOLENE® 76 post-rinse concentrate (having trivalent chromium as its primary active ingredient), PARCOLENE® 90 post-rinse concentrate (having phosphoric and hydrofluoric acids and an N-methylethanolamino-modified polymer of 4-vinylphenol as its primary active ingredients), and DEOXYLYTE® 54 NC concentrate (having fluorozirconic acid and ammonia as its primary active ingredients), and directions for their use, including apparatus and directions for determining point values for FA and TA if specified above, are all commercially available from the Henkel Surface Technologies Div. of Henkel Corp., Madison Heights, Mich.

Phosphate coating "weights" (actually masses per unit area of substrate surface coated) and losses thereof were determined by X-ray fluorescence with an ASOMA Model 8620 X-ray fluorescence analyzer, used according to the manufacturer's directions, or by conventional weigh-strip-weigh methods as known to those skilled in the art.

Painted substrates were tested according to at least one of the test procedures Ford Motor Co. APGE (50 cycles), General Motors Corp. 9540P (40cycles), and 3 month Florida Exposure (American Society for Testing and Materials Procedure G7, using 5% NaCl solution twice weekly, 45° South exposure, and open backed conditions). In each instance, panels thus tested were evaluated by averaging the maximum millimeters (hereinafter usually abbreviated as "mm") of width of undercutting across a scribe line that had been made through the coating to bare metal before testing, these width measurements being made at 10 mm or 25 mm intervals along the scribe line on each of two or three replicate panels for each processing sequence tested, after any loose paint had been removed by tape pulling.

Table 2 shows any coating weight losses from the previously phosphate conversion coated substrates as a consequence of contact with some post-rinse compositions. Table 2 also shows the effect of these post-rinse compositions on cleaned only substrates that had no phosphate conversion coating to remove. The results on these samples indicated a gain in coating weight, presumably as a consequence of a different type of conversion coating that the compositions used according to this invention as post-rinses are known to be capable of forming when used on clean bare metal.

The results in Table 2 indicate that concentrated or low pH compositions otherwise suitable for use in a process according to the invention may be too aggressive in removing an already existing conversion coating and therefore are preferably avoided in most instances. An extremely concentrated composition such as 6.5 not only removes all of the conversion coating but attacks the underlying metal, so that the "coating loss" reported may even be larger than the original coating weight.

Table 3 summarizes accelerated testing results for processes that continued three of the processes reported in Table 2 through painting and testing stages, along with some comparison tests. DIW is regarded as the "control" post-rinse for this Table 3, and the result cell of the table for other post-rinses has a capital letter "B" at its right if the statistics of the measurements indicate at least a 95% probability that the result with another post-rinse is better than with DIW, a capital letter "W" at its right if the statistics of the measurements indicate at least a 95% probability that the result with another post-rinse is worse than with DIW, and a capital letter "S" if the statistics do not support either conclusion within this confidence level value. The Student-T test was used to determine the statistical confidence. The entry "TAF" in a result cell indicates "total adhesion failure" of the paint over the entire panel.

TABLE 2

COATING WEIGHT LOSS OR GAIN FROM CONTACT WITH POST-RINSES

| Substrate | Coating Weight Method | Characteristic Measured | Value in Grams per Square Meter for Post-Rinse Composition Number: 6.2 | 6.3 | 6.4 | 6.5 |
|---|---|---|---|---|---|---|
| CRS | X-ray | PhosCoatWght | 2.1 | 2.1 | 1.9 | 2.0 |
| | | Coating Loss | 0.6 | 1.4 | 0.1 | 2.0 |
| | Weigh | PhosCoatWght | 2.2 | 2.2 | 2.1 | 2.2 |
| | & Strip | Coating Loss | 0.6 | 1.3 | 0.1 | 2.1 |
| | | No Phosphate Coating | — | — | — | — |
| | | Coating Gain | 0.1 | 0.1 | 0.1 | n.m. |
| EG | X-ray | PhosCoatWght | 2.6 | 2.6 | 2.7 | 2.6 |
| | | Coating Loss | 0.8 | 1.3 | 0.1 | 2.2 |
| | Weigh | PhosCoatWght | 2.1 | 2.8 | 2.8 | n.m. |
| | & Strip | Coating Loss | 0.1 | 1.4 | 0.2 | 5.2 |
| | | No Phosphate Coating | — | — | — | — |
| | | Coating Gain | 0.1 | 0.1 | 0.1 | n.m. |
| EGA | X-ray | PhosCoatWght | 2.1 | 2.0 | 1.9 | 2.1 |
| | | Coating Loss | 0.5 | 1.0 | 0.02 | 2.1 |
| | Weigh | PhosCoatWght | 2.3 | 2.2 | 2.2 | n.m. |
| | & Strip | Coating Loss | 0.6 | 1.1 | 0.1 | 3.8 |
| | | No Phosphate Coating | — | — | — | — |
| | | Coating Gain | 0.05 | 0.05 | 0.06 | n.m. |
| A6111 | X-ray | PhosCoatWght | 3.5 | 3.7 | 3.4 | 3.8 |
| | | Coating Loss | 0.8 | 1.9 | 0.2 | 3.8 |
| | Weigh | PhosCoatWght | 3.4 | 3.4 | 3.7 | n.m. |
| | & Strip | Coating Loss | 0.7 | 1.4 | 0.6 | 3.8 |
| | | No Phosphate Coating | — | — | — | — |
| | | Coating Gain | 0.04 | 0.05 | 0.06 | n.m. |

Abbreviations and Other Notes for Table 2
"PhosCoatWght" means "Phosphate Coating Weight"; "n.m." means "not measured"; "—" means not applicable.
For all substrates reported in this table, any phosphate coating shown was formed by step 4.1 as described in the main text.

In general, when post rinsing with a composition other than DIW was used and no initial phosphate coating was present, corrosion resistance in the GM9540P and APGE tests on EGA and A6111 substrates improved, on EG substrates remained the same or improved, and on CRS greatly decreased, compared with DIW. GM9540P testing of the phosphated panels indicates that post treatment 6.2 or 6.4 can significantly reduce corrosion of CRS, EG, and EGA compared with DIW; A6111 performance was statistically equal. When post treatment 6.3 was used, EG, EGA, and A6111 performance, compared with DIW, significantly improved while CRS remained statistically equivalent.

APGE testing of the same variations of post treatment over phosphated surfaces suggests that none of the post treatments in Table 3 enhance performance on phosphated CRS, EG, or A6111 but that all of them could improve phosphated EGA performance. Phosphated CRS treated with composition 6.4, the most preferred for a process according to the invention among the compositions listed in Table 3, exhibited equivalent performance in the APGE test compared with DIW, but the two post-rinses with the same active ingredients (but different concentration or pH) were dramatically inferior on phosphated CRS. The trend in automotive accelerated testing today, however, is away from the APGE type test and towards those similar to the GM9540P, which have been reported effectively to predict non-accelerated outdoor exposure results, particularly on zinc and zinc alloy substrates. Thus the results with the APGE test are not considered particularly relevant to practical service.

In the GM9540P test, which is believed to be more practically relevant, only CRS among the phosphated substrates led to a strong preference for Post-rinse 6.4 compared with Post-rinses 6.2 or 6.3 with the same active ingredients—all three often produced significantly better, but never produced significantly worse, results than DIW on all four phosphated substrates in this test.

The next group of tests examined performance over nickel-free zinc manganese phosphate coating. Results are shown in Table 4. The capital letters at the right of result cells for treatment according to the invention have the same meaning as in Table 3. In only one instance, CRS with Phosphating Method 4.2, evaluated by Florida Exposure, was a post-rinse according to the invention observed to

TABLE 3

ACCELERATED CORROSION TEST RESULTS

| Substrate | Accelerated Test | Phosphate Treatment? | Result with Post-Rinse of: DIW | 6.2 | | 6.3 | | 6.4 | |
|---|---|---|---|---|---|---|---|---|---|
| CRS | GM9540P | Yes | 9.6 | 4.2 | B | 8.8 | S | 3.1 | B |
| CRS | APGE | Yes | 4.3 | 8.2 | W | 13.7 | W | 4.0 | S |
| CRS | GM9540P | No | 19.0 | 25.5 | W | 24.1 | W | 31.3 | W |
| CRS | APGE | No | 23.7 | TAF | W | TAF | W | TAF | W |
| EG | GM9540P | Yes | 2.2 | 1.8 | B | 1.6 | B | 1.8 | B |
| EG | APGE | Yes | 3.4 | 3.8 | S | 3.9 | W | 3.3 | S |
| EG | GM9540P | No | 2.4 | 2.6 | S | 2.9 | S | 1.8 | B |
| EG | APGE | No | 13.5 | 6.2 | B | 6.4 | B | 9.0 | B |
| EGA | GM9540P | Yes | 2.2 | 1.1 | B | 1.3 | B | 1.6 | B |
| EGA | APGE | Yes | 2.7 | 2.1 | B | 2.1 | B | 1.8 | B |
| EGA | GM9540P | No | 6.8 | 5.4 | B | 5.7 | B | 7.1 | S |
| EGA | APGE | No | 32.0 | 11.9 | B | 18.9 | B | 8.7 | B |
| A6111 | GM9540P | Yes | 1.2 | 1.2 | S | 0.8 | B | 1.0 | S |
| A6111 | APGE | Yes | 1.3 | 0.8 | S | 1.2 | S | 0.9 | S |
| A6111 | GM9540P | No | 1.7 | 1.2 | B | 0.9 | B | 1.2 | B |
| A6111 | APGE | No | 12.0 | 6.0 | B | 6.0 | B | 11.0 | S |

significantly lower corrosion resistance compared with DIW, and that lowering was very small. In contrast, CRS with Phosphating Method 4.3, evaluated by the same Florida exposure test, resulted in significantly better performance than DIW. Compared with DIW, statistically significant performance improvements with a post-rinse according to the invention were noted for CRS and A6111 evaluated by the GM9540P test, EG evaluated using the Florida exposure test, and A6111 evaluated by the APGE test.

TABLE 4

ACCELERATED CORROSION TEST RESULTS WITH VARIED PHOSPHATE COATINGS

| Sub-strate | Accelerated Test | Phosphating Method | Post-Rinse DIW | Post-Rinse 6.4 | |
|---|---|---|---|---|---|
| CRS | GM9540P | 4.2 | 7.16 | 6.31 | B |
| CRS | GM9540P | 4.3 | 7.92 | 5.99 | B |
| CRS | APGE | 4.2 | 6.69 | 7.02 | S |
| CRS | APGE | 4.3 | 7.72 | 8.1 | S |
| CRS | 3 Month Florida | 4.2 | 6.03 | 6.57 | W |
| CRS | 3 Month Florida | 4.3 | 6.71 | 6.27 | B |
| EG | GM9540P | 4.2 | 2.19 | 1.82 | S |
| EG | GM9540P | 4.3 | 2.82 | 3.09 | S |
| EG | APGE | 4.2 | 3.93 | 4.14 | S |
| EG | APGE | 4.3 | 3.64 | 4.09 | S |
| EG | 3 Month Florida | 4.2 | 2.82 | 2.42 | B |
| EG | 3 Month Florida | 4.3 | 3.88 | 3.46 | B |
| A6111 | GM9540P | 4.3 | 2.08 | 0.28 | B |
| A6111 | APGE | 4.3 | 4.33 | 1.15 | B |
| A6111 | 3 Month Florida | 4.3 | 2.77 | 1.48 | S |

Table 5 details accelerated testing results for immersion phosphated CRS, EG, EGA, and A6111 substrates treated according to the invention and compared with three currently commercial post-rinses and DIW. In Table 5, treatment according to the invention is regarded as the "control"; except for this change of reference, the capital letters on the right sides of result cells in Table 5 have the same meaning as in previous tables.

When judged using the GM9540P test, treatment over CRS according to a preferred embodiment of the invention significantly out performed all other post treatments. Results over EG are much less clear, and little confidence is placed in them because they show DIW generally as good as the commercial post-rinses, contrary to practical experience with zinc phosphate conversion coatings. Over EGA and A61 11, treatment according to the invention usually produced about the same results as the currently commercial post-rinses tested, and thus have an economic advantage, because the cost of treatment compositions according to the invention is lower.

The invention claimed is:

1. A process for post-rinsing a conversion coating on a metal substrate to improve the corrosion resistance of the coating, said process comprising a step of contacting the conversion coating for a time of at least 1 second with a liquid post-rinse composition comprising water and:

(A) a component of fluorometallate anions, each of said anions consisting of (i) at least four fluorine atoms, (ii) at least one atom of an element selected from the group consisting of titanium, zirconium, hafnium, silicon, aluminum, and boron, and, optionally, one or both of (iii) at least one ionizable hydrogen atom, and (iv) at least one oxygen atom;

(B) a component of divalent or tetravalent cations of elements selected from the group consisting of cobalt, magnesium, manganese, zinc, nickel, tin, copper, zirconium, iron, and strontium;

(C) a component of phosphorus-containing inorganic oxyanions, phosphonate anions, or both; and (D) a component of water-soluble, water-dispersible, or both water-soluble and water-dispersible organic polymers, polymer-forming resins, or both.

2. A process according to claim 1, wherein said liquid post-rinse composition has a pH from 2.3 to 6.0 and comprises water and:

(A') a concentration of at least about 0.0010 M/kg of component (A);

TABLE 5

RESULTS OVER IMMERSION PHOSPHATED SUBSTRATES

| Sub-strate | Accelerated Test | Phosphating Method | Test Result with Post-Rinse: 6.4 | 6.6 | | 6.7 | | 6.8 | | DIW | |
|---|---|---|---|---|---|---|---|---|---|---|---|
| CRS | GM9540P | 4.4 | 5.12 | 5.29 | S | 5.63 | W | 6.85 | W | 9.04 | W |
| CRS | GM9540P | 4.5 | 4.48 | 6.58 | W | 4.94 | W | 5.98 | W | 10.0 | W |
| CRS | APGE | 4.4 | 5.33 | 4.79 | S | 4.19 | B | 3.79 | B | 5.45 | S |
| CRS | APGE | 4.5 | 5.41 | 5.21 | S | 4.76 | S | 5.95 | S | 4.79 | S |
| CRS | 3 Month Florida | 4.4 | 4.37 | 5.21 | W | 4.59 | W | 5.41 | W | 5.68 | W |
| CRS | 3 Month Florida | 4.5 | 4.73 | 5.59 | W | 5.36 | W | 5.36 | W | 6.04 | W |
| EG | GM9540P | 4.4 | 4.58 | 3.58 | B | 3.33 | B | 2.82 | B | 3.02 | B |
| EG | GM9540P | 4.5 | 2.55 | 2.46 | S | 3.17 | W | 3.64 | W | 2.45 | S |
| EG | APGE | 4.4 | 6.00 | 6.24 | S | 4.93 | B | 5.36 | B | 5.96 | S |
| EG | APGE | 4.5 | 6.32 | 5.43 | B | 5.19 | B | 5.76 | S | 5.71 | S |
| EG | 3 Month Florida | 4.4 | 2.56 | 1.86 | B | 2.82 | S | 3.20 | W | 2.36 | S |
| EG | 3 Month Florida | 4.5 | 2.05 | 2.02 | S | 2.76 | W | 3.21 | W | 2.55 | S |
| EGA | GM9540P | 4.4 | 1.18 | 1.24 | S | 1.50 | S | 1.31 | S | 2.26 | W |
| EGA | GM9540P | 4.5 | 1.74 | 1.38 | B | 0.88 | B | 1.25 | B | 2.12 | W |
| EGA | APGE | 4.4 | 2.78 | 3.22 | S | 2.79 | S | 3.01 | S | 3.37 | W |
| EGA | APGE | 4.5 | 2.24 | 2.56 | S | 2.37 | S | 2.2 | S | 3.19 | W |
| EGA | 3 Month Florida | 4.4 | 0.37 | 0.73 | W | 0.68 | S | 0.88 | S | 0.68 | S |
| EGA | 3 Month Florida | 4.5 | 0.48 | 0.24 | S | 0.50 | S | 0.61 | S | 0.72 | S |
| A6111 | GM9540P | 4.5 | 0.49 | 0.20 | B | 0.68 | S | 0.50 | S | 2.17 | W |
| A6111 | APGE | 4.5 | 0.78 | 1.05 | S | 1.19 | S | 0.57 | S | 3.51 | W |
| A6111 | 3 Month Florida | 4.5 | 3.24 | 2.65 | S | 3.08 | S | 3.17 | S | 2.35 | S |

(B') a concentration of component (B), measured in M/kg, that has a ratio to the concentration of component (A), also measured in M/kg, that is from about 0.20:1.0 to about 3:1.0;

(C') a concentration of component (C) that corresponds stoichiometrically to a concentration of at least about 0.0015 M/kg of phosphorus atoms, said concentration of phosphorus atoms having a ratio to the concentration of component (A), measured in the same units, that is from about 0.12:1.0 to about 5.0:1.0; and (D') a concentration of solids of component (D) that has a ratio to the concentration of component (A) that is from about 0.2:1.0 to about 3.0:1.0.

3. A process according to claim 2, wherein at least about 60% of component (B) consists of nickel, cobalt, manganese, or magnesium and component (D) is selected from the group consisting of polymers and copolymers of one or more y-(N-R'-N-$R^2$-amino-methyl)4-hydroxy-styrenes, where y=2, 3, 5, or 6, $R^1$ represents an alkyl group containing from 1 to 4 carbon atoms, and $R^2$ represents a substituent group conforming to the general formula $H(CHOH)_nCH_2$—, where n is an integer from 1 to 7.

4. A process according to claim 3, wherein, in the post-rinse composition: the pH value is from about 2.5 to about 5.5; the concentration of component (A) is from about 0.0020 to about 0.06 M/kg; the ratio of the concentration of component (B) in M/kg to the concentration of component (A) in M/kg is from about 0.40:1.0 to about 2.5:1.0; the ratio of the stoichiometric equivalent as phosphorus atoms from component (C) in M/kg to the concentration of component (A) in M/kg is from about 0.35:1.0 to about 3.5:1.0; the concentration of solids of component (D) is from about 0.030 to about 0.6% of the total composition; and the ratio of the concentration of solids of component (D) to the concentration of component (A) is from about 0.75:1.0 to about 2.0:1.0.

5. A process according to claim 4, wherein: component (A) is selected from the group consisting of fluorotitanate and fluorozirconate; component (B) is selected from the group consisting of manganese, cobalt, and nickel; component (C) is selected from the group consisting of orthophosphates, phosphites, hypophosphites, and pyrophosphates; and component (D) is selected from the group consisting of polymers and copolymers of one or more y-(N-$R^1$-N-$R^2$-aminomethyl)-4-hydroxy-styrenes, where y=2, 3, 5, or 6, $R^1$ represents an alkyl group containing from 1 to 4 carbon atoms, and $R^2$ represents a substituent group conforming to the general formula $H(CHOH)_nCH_2$—, where n is an integer from 3 to 5.

6. A process according to claim 5, wherein, in the post-rinse composition: the pH value is from about 2.7 to about 4.5; the concentration of component (A) is from about 0.0040 to about 0.014 M/kg; the ratio of the concentration of component (B) in M/kg to the concentration of component (A) in M/kg is from about 0.70:1.0 to about 1.8:1.0; the ratio of the stoichiometric equivalent as phosphorus atoms from component (C) in M/kg to the concentration of component (A) in M/kg is from about 0.85:1.0 to about 1.8:1.0; the concentration of solids of component (D) is from about 0.080 to about 0.20% of the total composition; and the ratio of the concentration of solids of component (D) to the concentration of component (A) is from about 0.90:1.0 to about 1.7:1.0.

7. A process according to claim 6, wherein, in the post-rinse composition: the pH value is from about 3.20 to about 4.1; component (A) is fluorotitanate in a concentration from about 0.0050 to about 0.0070 M/kg; at least 95% of component (B) is manganese; the ratio of the concentration of component (B) in M/kg to the concentration of component (A) in M/kg is from about 0.90:1.0 to about 1.20:1.0; component (C) is orthophosphate anions; the ratio of the stoichiometric equivalent as phosphorus atoms from component (C) in M/kg to the concentration of component (A) in M/kg is from about 1.05:1.0 to about 1.25:1.0; the average molecular weight of component (D) is from about 3,000 to about 20,000; the concentration of solids of component (D) is from about 0.100 to about 0.16% of the total composition; and the ratio of the concentration of solids of component (D) to the concentration of component (A) is from about 1.10:1.0 to about 1.5:1.0.

8. A process according to claim 7, wherein the conversion coating that is post-rinsed is a phosphate conversion coating containing both zinc and manganese cations.

9. A process according to claim 8, wherein either:

the metal substrate is cold rolled steel, electrogalvanized steel, or electrocoated zinc-iron alloy and the phosphate conversion coating contains nickel cations; or the metal substrate is cold rolled steel, electrocoated zinc-iron alloy, or an aluminum alloy that contains at least 90% of aluminum and the phosphate conversion coating contains not more than 0.2% of nickel cations.

10. A process according to claim 6, wherein the conversion coating that is post-rinsed is a phosphate conversion coating containing both zinc and manganese cations.

11. A process according to claim 10, wherein either:

the metal substrate is cold rolled steel, electrogalvanized steel, or electrocoated zinc-iron alloy and the phosphate conversion coating contains nickel cations; or the metal substrate is cold rolled steel, electrocoated zinc-iron alloy, or an aluminum alloy that contains at least 90% of aluminum and the phosphate conversion coating contains not more than 0.2% of nickel cations.

12. A process according to claim 5, wherein the conversion coating that is post-rinsed is a phosphate conversion coating containing both zinc and manganese cations.

13. A process according to claim 12, wherein either:

the metal substrate is cold rolled steel, electrogalvanized steel, or electrocoated zinc-iron alloy and the phosphate conversion coating contains nickel cations; or the metal substrate is cold rolled steel, electrocoated zinc-iron alloy, or an aluminum alloy that contains at least 90% of aluminum and the phosphate conversion coating contains not more than 0.2% of nickel cations.

14. A process according to claim 4, wherein the conversion coating that is post-rinsed is a phosphate conversion coating containing both zinc and manganese cations.

15. A process according to claim 14, wherein either:

the metal substrate is cold rolled steel, electrogalvanized steel, or electrocoated zinc-iron alloy and the phosphate conversion coating contains nickel cations; or the metal substrate is cold rolled steel, electrocoated zinc-iron alloy, or an aluminum alloy that contains at least 90% of aluminum and the phosphate conversion coating contains not more than 0.2% of nickel cations.

16. A process according to claim 3, wherein the conversion coating that is post-rinsed is a phosphate conversion coating containing both zinc and manganese cations.

17. A process according to claim 16, wherein either:

the metal substrate is cold rolled steel, electrogalvanized steel, or electrocoated zinc-iron alloy and the phosphate conversion coating contains nickel cations; or the metal substrate is cold rolled steel, electrocoated zinc-iron alloy, or an aluminum alloy that contains at least 90% of aluminum and the phosphate conversion coating contains not more than 0.2% of nickel cations.

18. A process according to claim 2, wherein the conversion coating that is post-rinsed is a phosphate conversion coating containing both zinc and manganese cations.

19. A process according to claim 18, wherein either:

the metal substrate is cold rolled steel, electrogalvanized steel, or electrocoated zinc-iron alloy and the phosphate conversion coating contains nickel cations; or the metal substrate is cold rolled steel, electrocoated zinc-iron alloy, or an aluminum alloy that contains at least 90% of aluminum and the phosphate conversion coating contains not more than 0.2% of nickel cations.

20. A process according to claim 1, wherein the conversion coating that is post-rinsed is a phosphate conversion coating containing both zinc and manganese cations.

* * * * *